US011518176B2

(12) United States Patent
Okeguchi

(10) Patent No.: US 11,518,176 B2
(45) Date of Patent: Dec. 6, 2022

(54) MAINTENANCE JIG, LIQUID DISCHARGE APPARATUS, HEAD CLEANING METHOD, UNIT, AND LIQUID DISCHARGE SYSTEM

(71) Applicant: Ricoh Company, Ltd., Tokyo (JP)

(72) Inventor: Muneyuki Okeguchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/198,349

(22) Filed: Mar. 11, 2021

(65) Prior Publication Data

US 2021/0291526 A1 Sep. 23, 2021

(30) Foreign Application Priority Data

Mar. 23, 2020 (JP) ..... JP2020-050529

(51) Int. Cl.
*B41J 2/175* (2006.01)
*B41J 2/165* (2006.01)

(52) U.S. Cl.
CPC ..... *B41J 2/1754* (2013.01); *B41J 2/17533* (2013.01); *B41J 2/17536* (2013.01); *B41J 2/16508* (2013.01)

(58) Field of Classification Search
CPC .. B41J 2/1754; B41J 2/17533; B41J 2/17536; B41J 2/16508
See application file for complete search history.

(56) References Cited

U.S. PATENT DOCUMENTS 6,062,390 A * 5/2000 Nakamura ..... B41J 2/17533 53/469
2018/0361761 A1 12/2018 Okeguchi et al.
2020/0094582 A1 3/2020 Okeguchi et al.

FOREIGN PATENT DOCUMENTS

JP 2013-136162 7/2013
JP 2016-112766 6/2016

* cited by examiner

*Primary Examiner* — Geoffrey S Mruk
(74) *Attorney, Agent, or Firm* — Xsensus LLP

(57) ABSTRACT

A maintenance jig includes a protector and an opening. The protector is configured to be attached to a head that has a nozzle surface including a nozzle row to discharge liquid or a head holder that holds the head. The protector is configured to protect the nozzle row. The opening is adjacent to the protector in a lateral direction of the nozzle row intersecting a longitudinal direction of the nozzle row. A distance between an end of the protector in the longitudinal direction of the nozzle row and the nozzle surface is larger than a distance between a portion of the protector other than the end of the protector in the longitudinal direction and the nozzle surface when the maintenance jig is attached to the head or the head holder.

11 Claims, 9 Drawing Sheets

MAINTENANCE JIG, LIQUID DISCHARGE APPARATUS, HEAD CLEANING METHOD, UNIT, AND LIQUID DISCHARGE SYSTEM

CROSS-REFERENCE TO RELATED APPLICATION

This patent application is based on and claims priority pursuant to 35 U.S.C. § 119(a) to Japanese Patent Application No. 2020-050529, filed on Mar. 23, 2020, in the Japan Patent Office, the entire disclosure of which is hereby incorporated by reference herein.

BACKGROUND

Technical Field

Embodiments of the present disclosure relate to a maintenance jig, a liquid discharge apparatus, a head cleaning method, a unit, and a liquid discharge system.

Description of the Related Art

In a printing apparatus that performs printing on a fabric, a nozzle surface of a liquid discharge head is periodically cleaned.

There is known a maintenance jig that includes a cover to cover a nozzle surface of a discharge head including nozzles in a state in which the maintenance jig is superimposed on the nozzle surface. The cover includes an opening that exposes a maintenance portion, which is a portion of the discharge head on which maintenance is to be performed.

SUMMARY

In an aspect of the present disclosure, a maintenance jig includes a protector and an opening. The protector is configured to be attached to a head that has a nozzle surface including a nozzle row to discharge liquid or a head holder that holds the head. The protector is configured to protect the nozzle row. The opening is adjacent to the protector in a lateral direction of the nozzle row intersecting a longitudinal direction of the nozzle row. A distance between an end of the protector in the longitudinal direction of the nozzle row and the nozzle surface is larger than a distance between a portion of the protector other than the end of the protector in the longitudinal direction and the nozzle surface when the maintenance jig is attached to the head or the head holder.

In another aspect of the present disclosure, a liquid discharge apparatus includes a head, a head holder, and a maintenance jig. The head has a nozzle surface including a plurality of nozzle rows configured to discharge liquids of different colors. The maintenance jig is configured to be attached to the head. The maintenance jig includes a protector and an opening. The protector is configured to protect the plurality of nozzle rows of the head. The opening is adjacent to the protector in a lateral direction of the plurality of nozzle rows. The lateral direction intersects a longitudinal direction of the nozzle row. The opening is configured to face a space between the plurality of nozzle rows that discharge liquids of different colors.

In still another aspect of the present disclosure, a head cleaning method includes attaching the maintenance jig to a head or a head holder configured to hold the head and cleaning a nozzle surface of the head through the opening.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
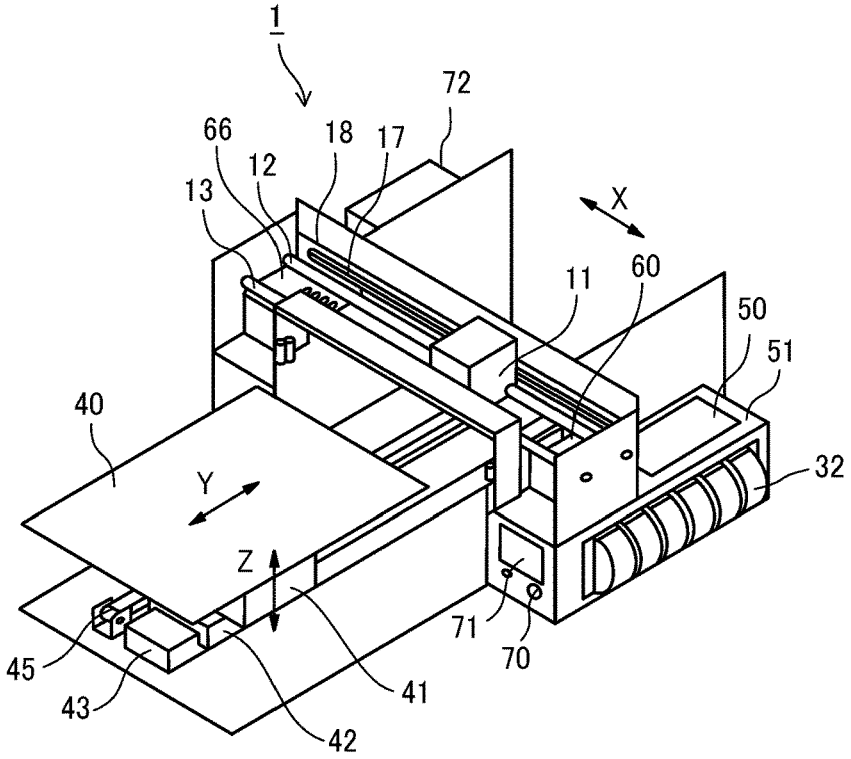
FIG. 1 is a perspective view of a printer according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 2:
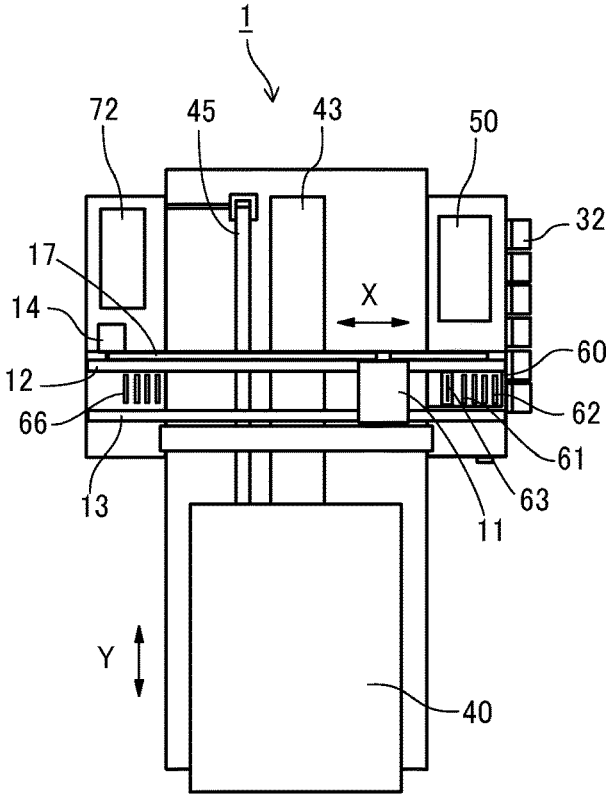
FIG. 2 is a plan view of the printer according to the first embodiment of the present disclosure.
Figure 3:
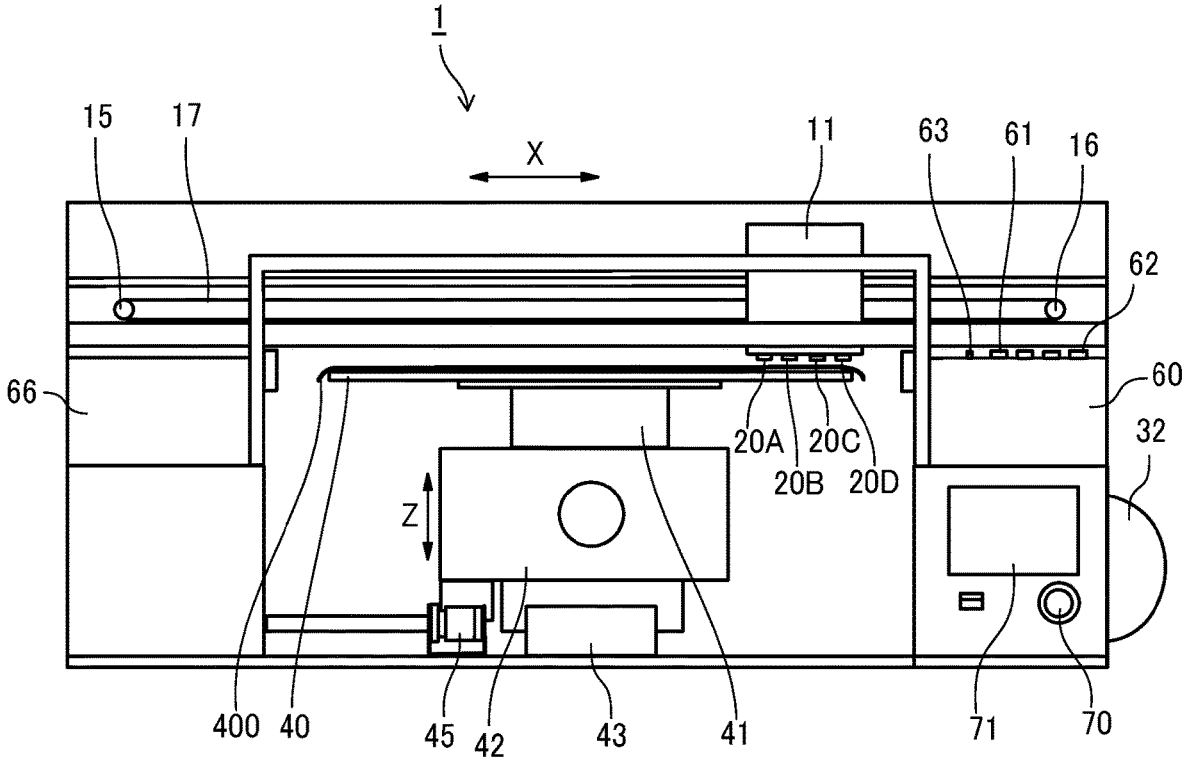
FIG. 3 is a front view of the printer according to the first embodiment of the present disclosure.
Figure 4:
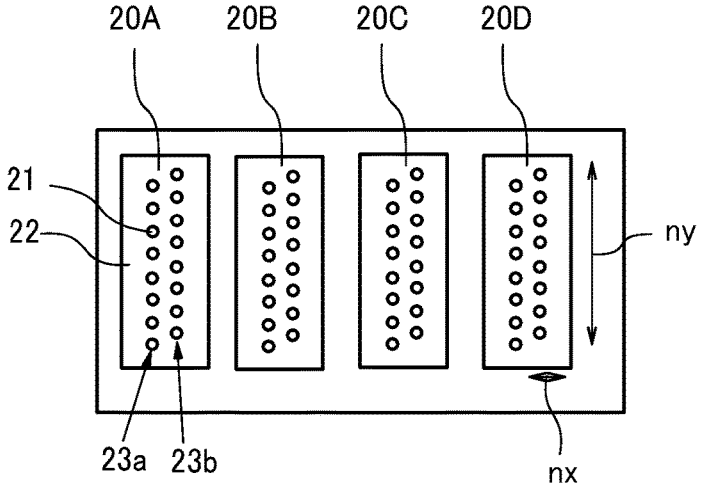
FIG. 4 is a plan view of discharge heads of the printer according to the first embodiment of the present disclosure.

Hereinafter, embodiments of the present disclosure are described with reference to the attached drawings. A printer 1 that discharges liquid including discharge heads to be cleaned with a maintenance jig according to an embodiment of the present disclosure is described with reference to FIGS. 1 to 4. FIG. 1 is a perspective view of the printer 1. FIG. 2 is a plan view of the printer 1. FIG. 3 is a front view of the printer 1. FIG. 4 is a plan view of the discharge heads of the printer 1.

The printer 1 is an apparatus that discharges liquid, and includes a carriage 11 on which a plurality of heads 20A, 20B, 20C, and 20D (hereinafter collectively referred to as heads 20, unless distinguished) which are liquid dischargers to discharge liquid, are mounted.

The printer 1 includes guides 12 and 13 to hold the carriage 11 such that the carriage 11 is reciprocally movable in a main scanning direction X indicated by arrow X in FIGS. 1 and 2. The carriage 11 is coupled to a timing belt 17 wound around a driving pulley 15 driven by a main scanning motor 14 and a driven pulley 16 (see FIGS. 2 and 3). The main scanning motor 14 is driven to reciprocally move the carriage 11 in the main scanning direction X.

An encoder sheet 18 (see FIG. 1) is disposed along the main scanning direction X. The encoder sheet 18 includes slits periodically formed on the encoder sheet 18. The carriage 11 includes a reading sensor that reads the slits of the encoder sheet 18. The printer 1 can detect the position of the carriage 11 in the main scanning direction X from the reading result of the reading sensor.

The printer 1 includes a controller board 50 that controls the heads 20 to discharge ink as liquid at a discharge position in a proper timing according to the carriage position obtained from the reading result of the reading sensor of the carriage 11.

The plurality of heads 20 (20A, 20B, 20C, and 20D) are mounted on the carriage 11, as illustrated in FIG. 4. As illustrated in FIG. 4, each of the heads 20A, 20B, 20C, and 20D has nozzle rows 23 (23*a* and 23*b* (collectively referred to as nozzle rows 23 unless distinguished)) in which a plurality of nozzles 21 for discharging liquid are arranged on a nozzle surface 22. Note that, in the nozzle rows 23*a* and 23*b* of each of the heads 20A, 20B, 20C, and 20D, a direction in which the nozzles 21 are aligned is referred to as a "longitudinal direction ny of the nozzle row", and a direction intersecting (here, orthogonal to) the longitudinal direction ny of the nozzle row is referred to as a "lateral direction nx of the nozzle row".

Main tanks 32 storing, for example, different color liquids of black (K), cyan (C), magenta (M), and yellow (Y) are detachably attached to a tank holder 51 provided in a body of the printer 1, as illustrated in FIG. 1. The liquids in the main tanks 32 are sent to the heads 20A, 20B, 20C, and 20D via supply paths and liquid feeders.

The printer 1 includes a platen 40 as a holder to hold a fabric 400 as a print target (liquid application target), as illustrated in FIG. 3. The platen 40 is mounted on a lift 41 so that the height of the platen 40 in a vertical direction Z can be adjusted. The printer 1 includes a slider 42 on which the lift 41 of the platen 40 is mounted. The printer 1 includes a slider rail 43 on which the slider 42 is movably mounted. The slider rail 43 is extended along on a sub scanning direction Y perpendicular to the main scanning direction X, as indicated by arrows X and Y in FIG. 1.

The slider 42 is reciprocally moved in the sub scanning direction Y by a sub-scan drive mechanism via a timing belt 45. Reciprocal movement of the slider 42 in the sub scanning direction Y also reciprocally moves the platen 40 in the sub scanning direction Y.

The printer 1 includes a maintenance unit 60 to maintain and recover the discharge performance of the heads 20. The maintenance unit 60 is disposed on one end (right-end in FIG. 3) of the printer 1 in the main scanning direction X. The maintenance unit 60 includes a suction cap 61 to cap the nozzle surface 22 of the head 20, a moisture-retention cap 62 to cap the nozzle surface 22 of the head 20 to keep moisture in the nozzle surface 22, and a wiper 63 to wipe the nozzle surface 22 of the head 20, as illustrated in FIGS. 2 and 3. The suction cap 61 is connected to a suction pump serving as a suction device.

The printer 1 includes a discharge receptacle 66 on another end (left end in FIG. 3) of the printer 1 in the main scanning direction X. The controller board 50 causes the head 20 to discharge liquid from the head 20 to the discharge receptacle 66 during printing to perform maintenance and recovery of the head 20.

The printer 1 further includes a power button 70, an operation unit 71, and a power unit 72, and the like.

When the printer 1 prints on a fabric (print target) such as a T-shirt, the fabric 400 is set on the platen 40. Then, the operation unit 71 is operated to fully pull the platen 40 rearward (upper rightward in FIG. 1) of the printer 1 via the slider 42.

When the platen 40 is fully pulled inside the printer 1, the printer 1 goes to a standby mode ready for print-data. At this time, the printer 1 starts a print operation when the printer 1 receives print data from an external information processing device. Alternatively, when print data is stored in the controller board 50 in advance, the print operation is started by selecting the print data on the operation unit 71.

When the printer 1 starts the print operation, the printer 1 moves the slider 42 to move the platen 40 to a printing start position at which the printer 1 starts the print operation. Then, the printer 1 moves the carriage 11 while discharging liquid from the heads 20 to perform one line of printing on the fabric 400. When the printer 1 prints the one line, the printer 1 moves the slider 42 to move the platen 40 by one line on the fabric 400. The printer 1 intermittently repeats one scanning movement of the carriage 11 in the main scanning direction X and a movement of the slider 42 in the sub-scanning direction Y to print an image on a desired region on the fabric 400. The printer 1 moves the platen 40 back to a front side (lower left side in FIG. 1) of the printer 1 to finish the print operation.

Figure 5A:
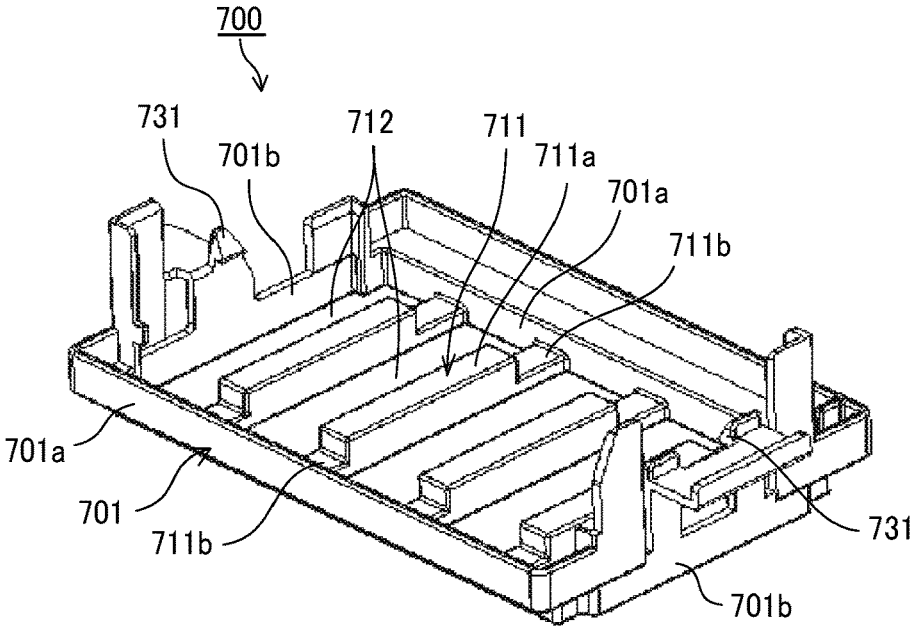
FIGS. 5A and 5B are perspective views of a maintenance jig according to the first embodiment of the present disclosure.
Figure 5B:
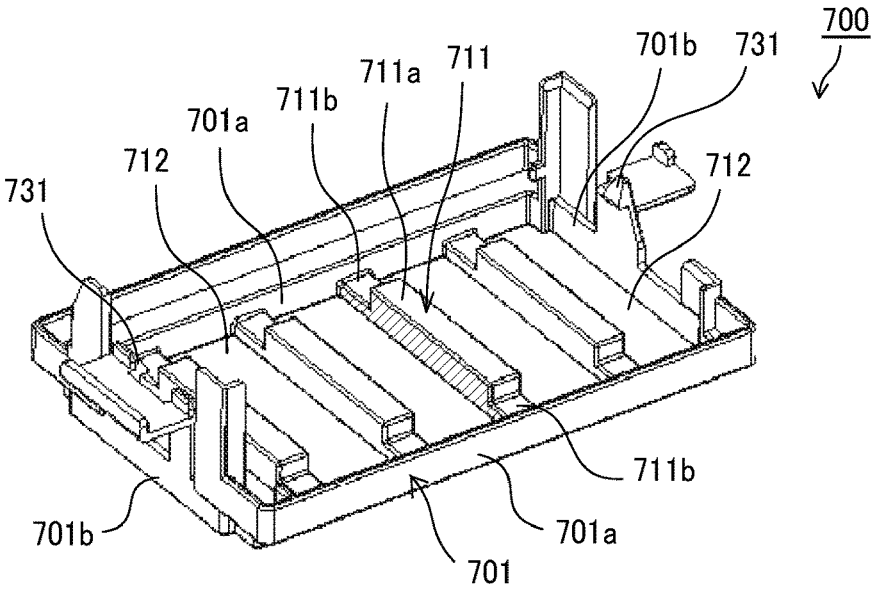
Figure 6A:
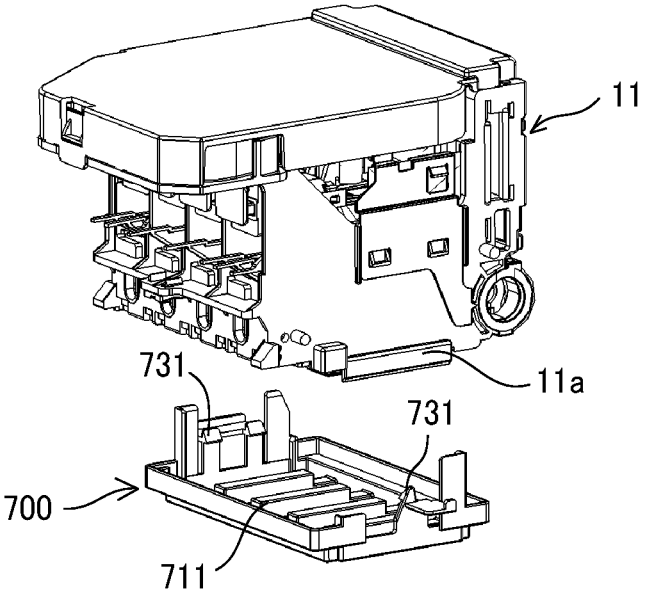
FIG. 6A is a perspective view of a carriage and the maintenance jig before the maintenance jig according to an embodiment of the present disclosure is attached to the carriage.
Figure 6B:
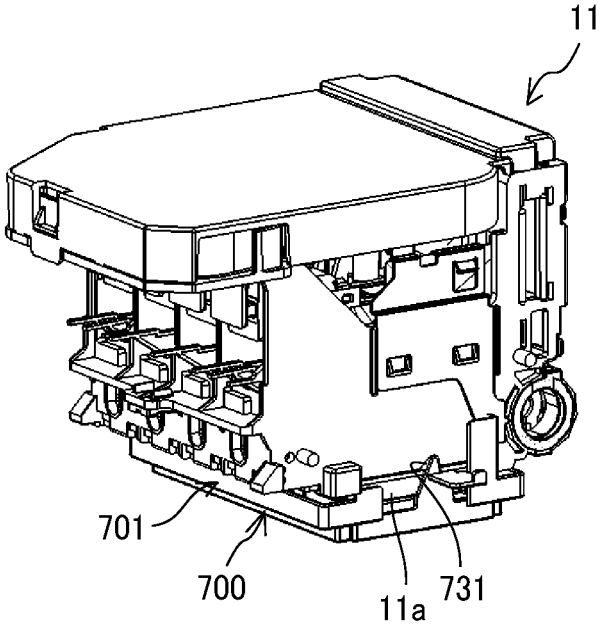
FIG. 6B is a perspective view of the carriage and the maintenance jig according to the first embodiment of the present disclosure in a state in which the maintenance jig is attached to a carriage.
Figure 7:
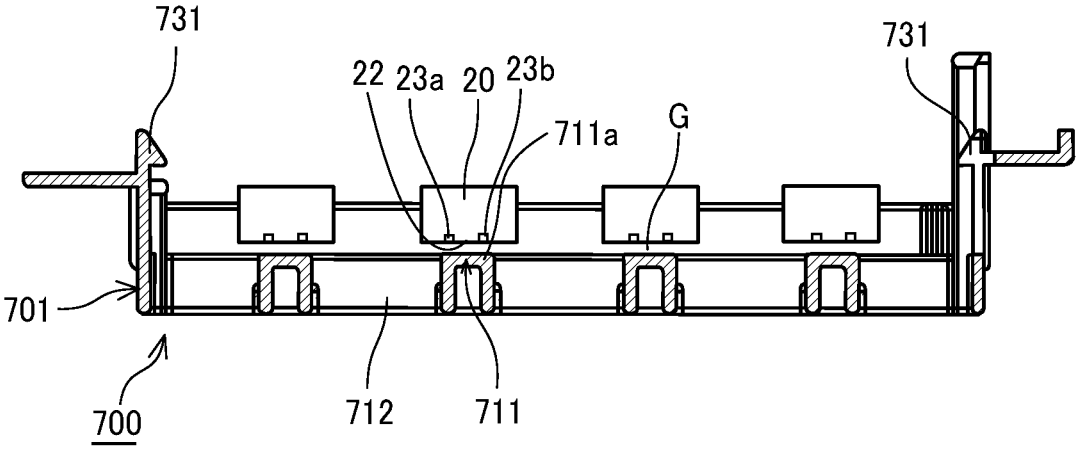
FIG. 7 is a cross-sectional view of the maintenance jig taken along a direction in which the discharge heads are arranged, according to the first embodiment of the present disclosure.
Figure 8:
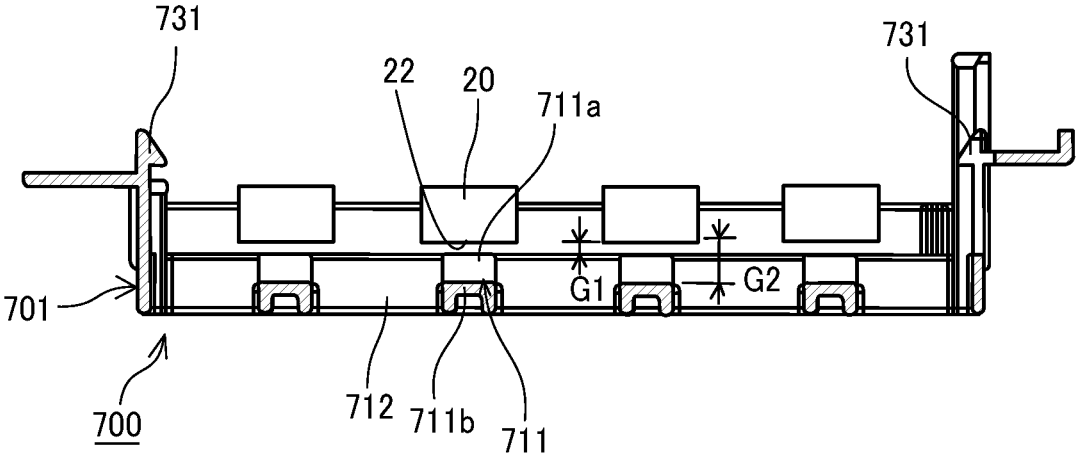
FIG. 8 is a cross-sectional view of the maintenance jig taken at a position different from FIG. 7 along a direction in which the discharge heads are arranged, according to the first embodiment of the present disclosure.
Figure 9:
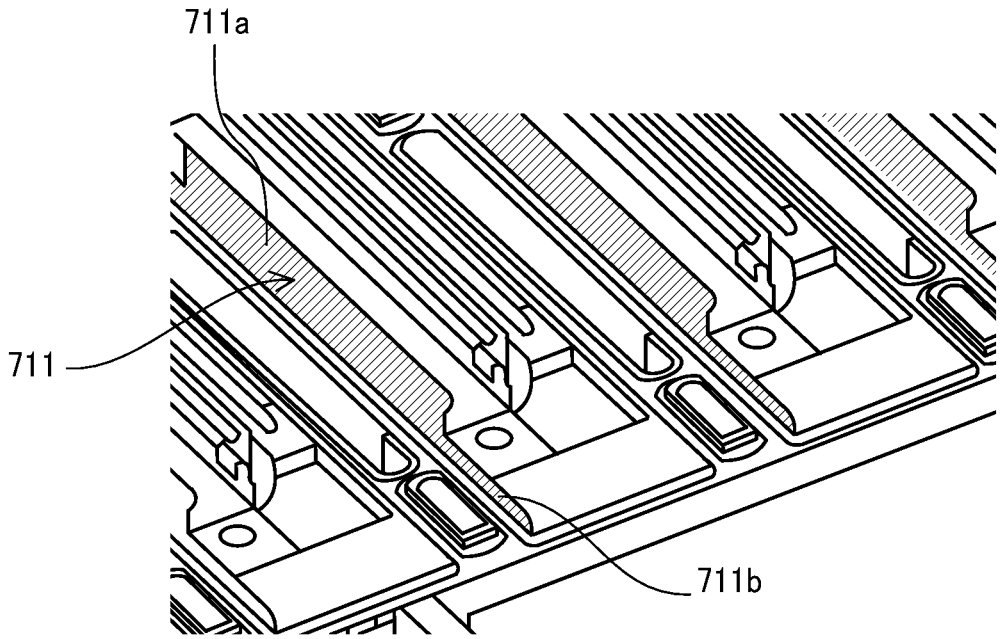
FIG. 9 is a perspective view of an end of the maintenance jig in a longitudinal direction of the discharge heads, according to the first embodiment of the present disclosure.

Referring to FIGS. 5A, 5B, 6A, 6B, 7, 8, and 9, a description is given of a maintenance jig 700 according to a first embodiment of the present disclosure. FIGS. 5A and 5B are perspective views of the maintenance jig 700. FIG. 6A is a perspective view of the maintenance jig 700 before the maintenance jig 700 is attached to the carriage 11. FIG. 6B is a perspective view of the maintenance jig 700 in a state in which the maintenance jig 700 is attached to the carriage 11. FIG. 7 is a cross-sectional view of the maintenance jig 700 taken along a direction in which the heads 20 are arranged. FIG. 8 is a cross-sectional view of the maintenance jig 700 taken at a position different from the position of FIG. 7 along the direction in which the heads 20 are arranged. FIG. 9 is a perspective view of an end of the maintenance jig 700 in the longitudinal direction of the heads 20.

The maintenance jig 700 includes a frame body 701, as illustrated in FIGS. 5A and 5B. The frame body 701 includes a frame 701*a* along a lateral direction (or short direction) of the nozzle row 23 (the alignment direction of the head 20) and a frame 701*b* along a longitudinal direction of the nozzle row 23.

A plurality of protectors 711 in the same number of the heads 20 are provided between frames 701*a*, as illustrated in FIGS. 5A and 5B. The protectors 711 protect the nozzle rows 23 of the nozzle surfaces 22 of the heads 20. In the lateral direction of the nozzle row 23, spaces between the protectors 711 adjacent to each other and spaces between the protectors 711 and the frames 701*b* at both ends of the lateral direction are provided as openings 712 adjacent to the protectors 711.

Each of the protectors 711 includes an opposite portion 711*a* facing the nozzle surface 22 of the head 20 and ends 711*b* in the longitudinal direction of the nozzle row 23. Note that a hatched portion in FIG. 5B corresponds to each of hatched portions in FIG. 9.

In the present embodiment, when the maintenance jig 700 is attached to the carriage 11, gaps (distance) G1 are generated between the protectors 711 and the nozzle surfaces 22 of the head 20, as illustrated in FIG. 7. At this time, as illustrated in FIG. 8, the distance G1 between each of the opposite portions 711*a* and the nozzle surface 22 and a distance G2 between each of the ends 711*b* and the nozzle surface 22 have a relation of G2>G1.

That is, the distance G2 between the end 711*b* of the protector 711 in the longitudinal direction of the nozzle row 23 and the nozzle surface 22 is larger than the distance G1 between the opposite portion 711*a*, which corresponds to a portion other than each end of the nozzle row 23 in the longitudinal direction of the nozzle row 23, and the nozzle surface 22.

As illustrated in FIGS. 5A and 5B, in the present embodiment, the frames 701*a* holding the protectors 711 are disposed on both ends in the longitudinal direction of the nozzle row 23 and serve as side walls of the protectors 711.

The frame body 701 is integrally provided with hooks (claws) 731. The hooks 731 are hooked on the carriage 11 when the maintenance jig 700 is attached to the carriage 11.

Figure 10:
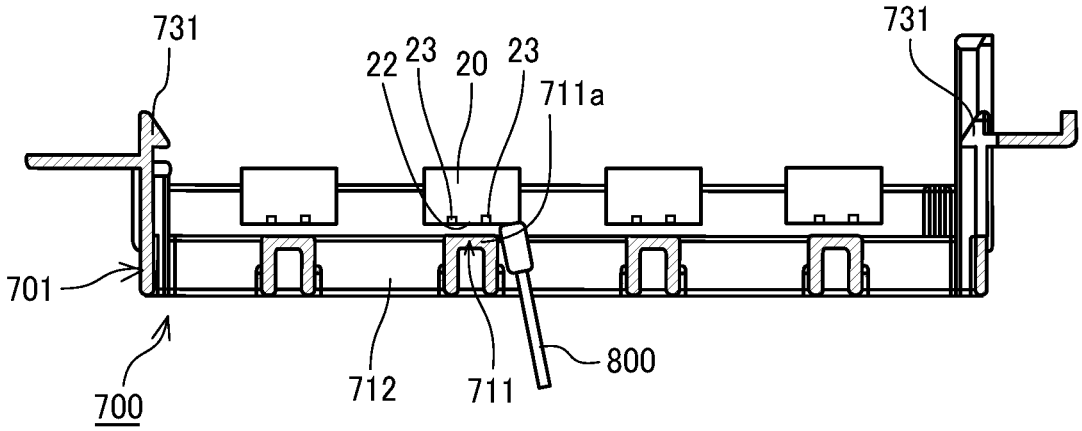
FIG. 10 is a cross-sectional view of the maintenance jig, similar to FIG. 7, illustrating operation of the maintenance jig according to the first embodiment of the present disclosure.
Figure 11:
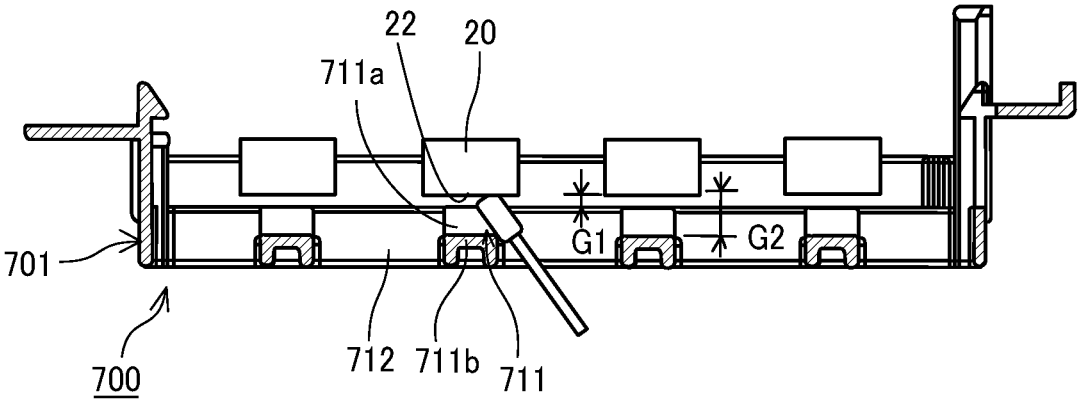
FIG. 11 is a cross-sectional view of the maintenance jig, similar to FIG. 8, illustrating operation of the maintenance jig according to the first embodiment of the present disclosure.
Figure 12:
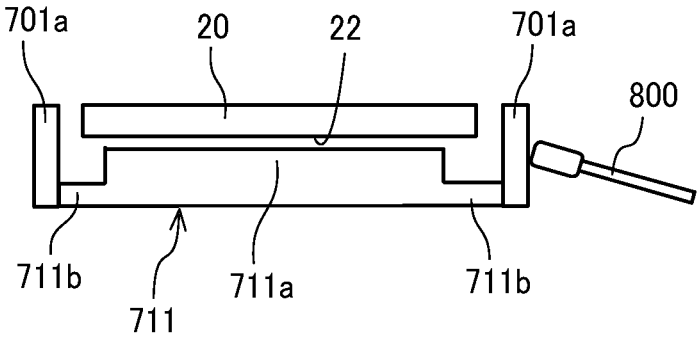
FIG. 12 is a cross-sectional view of the maintenance jig illustrating operation of the maintenance jig along the longitudinal direction of the discharge heads according to the first embodiment of the present disclosure.

Next, the operation of the maintenance jig 700 is described with reference to FIGS. 10, 11, and 12. FIGS. 10 and 11 are cross-sectional views of the maintenance jig 700 taken along the direction in which the heads 20 are arranged. FIG. 12 is a cross-sectional view of the maintenance jig 700 taken along the longitudinal direction of the heads 20.

As illustrated in FIGS. 6A and 6B described above, each of the hooks 731 of the maintenance jig 700 is hooked to a convex portion 11*a* of the carriage 11, and the maintenance jig 700 is attached to the carriage 11 that holds the heads 20.

In a state in which the maintenance jig 700 is attached to the carriage 11, as illustrated in FIG. 10, the opposite portion 711*a* of the protector 711 faces a region of the nozzle surface 22 on which the nozzles 21 are provided. On the other hand, as illustrated in FIG. 10, each of the openings 712 exposes a region (or an end portion in the lateral direction of the head 20) outside of the region of the nozzle surface 22 in which the nozzles 21 are provided.

Accordingly, as illustrated in FIG. 10, a cleaning stick 800 is insertable via the opening 712 of the maintenance jig 700 to clean the end of the nozzle surface 22 in the lateral direction. At this time, the nozzles 21 are protected with the protectors 711, and the cleaning stick 800 can clean the nozzle surface 22 without touching the nozzles 21.

Further, as illustrated in FIG. 11, the distance G2 between the end 711*b* of the protector 711 and the nozzle surface 22 is larger than the distance G1 between the opposite portion 711*a* and the nozzle surface 22. Accordingly, the cleaning stick 800 can be inserted between the end 711*b* and the nozzle surface 22 to clean the end of the nozzle surface 22 in the longitudinal direction of the nozzle row 23.

That is, in the present embodiment, a head cleaning method is performed including a step of attaching the maintenance jig 700 to the carriage 11 that holds the heads 20 and a step of cleaning the nozzle surfaces 22 of the heads 20 via the openings 712.

In this way, the ends of the nozzle surface 22 in the lateral direction of the nozzle row 23 and the ends of the nozzle surface 22 in the longitudinal direction of the nozzle row 23 can be cleaned without replacing the maintenance jig 700 and without touching the nozzles 21. Thus, the workability of the head cleaning operation is enhanced and the cleaning time can be shortened.

Further, in the present embodiment, the frames 701*a* serve as side walls disposed on lateral sides of the ends of the nozzle row 23 in the longitudinal direction. Thus, as illustrated in FIG. 12, the cleaning stick 800 cannot be inserted along the longitudinal direction of the nozzle row 23 from the ends of the nozzle row 23 in the longitudinal direction.

Such a configuration prevents the cleaning stick 800 from being inserted from the longitudinal direction of the nozzle row 23 and damaging the nozzles 21.

Figure 13:
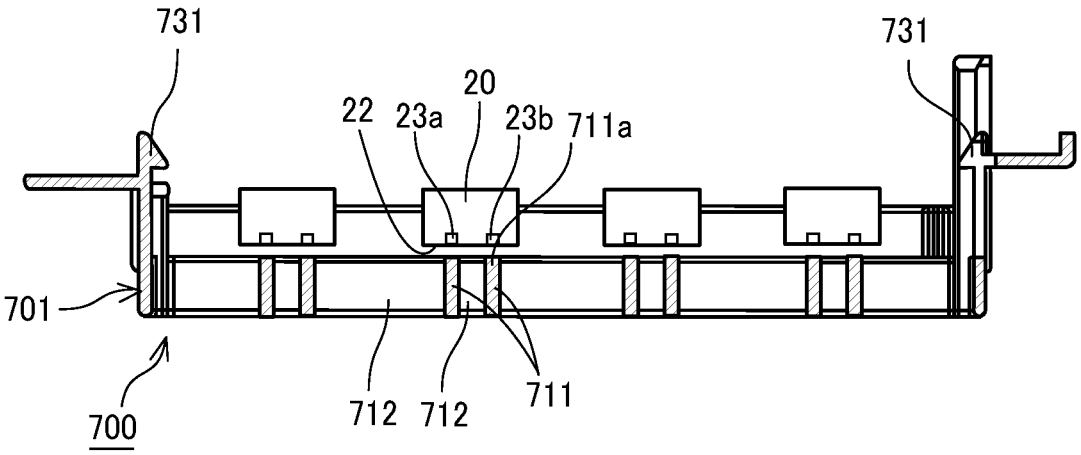
FIG. 13 is a cross-sectional view of a maintenance jig taken along a direction in which discharge heads are arranged, according to a second embodiment of the present disclosure.

Next, a second embodiment of the present disclosure is described with reference to FIG. 13. FIG. 13 is a cross-sectional view of a maintenance jig 700 taken along a direction in which heads 20 are arranged, according to the present embodiment.

In the present embodiment, the maintenance jig 700 also includes openings 712 between two nozzle rows 23*a* and 23*b* of the heads 20.

Accordingly, the maintenance jig 700 can clean a region of a nozzle surface 22 between the nozzle rows 23*a* and 23*b*.

Figure 14:
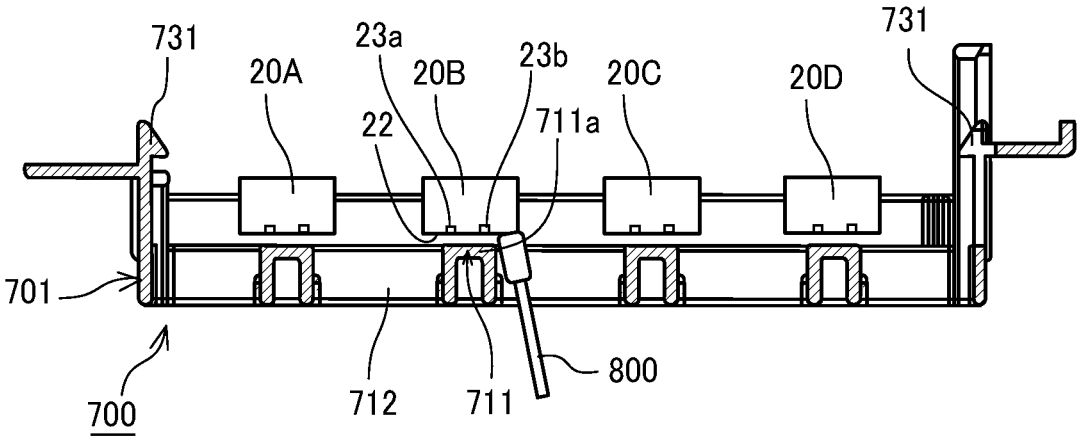
FIG. 14 is a cross-sectional view of a maintenance jig taken along a direction in which discharge heads are arranged, according to a third embodiment of the present disclosure.
Figure 15:
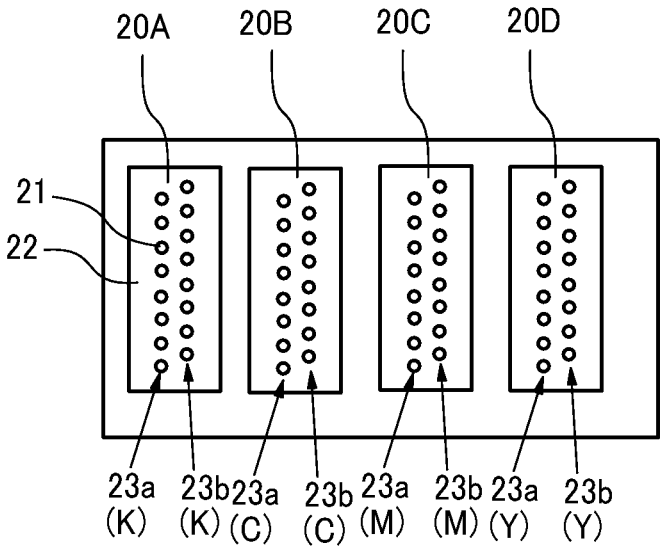
FIG. 15 is a plan view of heads including nozzle rows to which different colors are assigned, according to an embodiment of the present disclosure.

Next, a third embodiment of the present disclosure is described with reference to FIGS. 14 and 15. FIG. 14 is a cross-sectional view of a maintenance jig 700 taken along a direction in which the heads 20A, 20B, 20C, and 20D are arranged according to the present embodiment. FIG. 15 is a plan view of the heads 20A, 20B, 20C, and 20D, each including nozzle rows 23*a* and 23*b*, to which different colors are assigned.

In the present embodiment, the heads 20A, 20B, 20C, and 20D discharges liquid of black (K), cyan (C), magenta (M), and yellow (Y), respectively, from the pairs of nozzle rows 23*a* and 23*b*. In other words, each of the heads 20A, 20B, 20C, and 20D has the pair of nozzle rows 23*a* and 23*b* that discharge liquid of corresponding one of the different colors.

In the present embodiment, openings 712 are provided between adjacent ones of the heads 20A, 20B, 20C, and 20D. Thus, each of the openings 712 is provided at a position facing a space between each pair of the nozzle rows 23*a* and 23*b* that discharge liquid of corresponding one of different colors.

Color mixing may occur among a plurality of colors due to mist or the like. However, the configuration as described above can facilitate maintenance and enables efficient maintenance to prevent color mixing or the like.

In the above-described embodiments of the present disclosure, black, cyan, magenta, and yellow are used as examples. However, various liquids (inks) such as white, metallic, and special colors may also be used.

Note that, in the embodiments described above, the maintenance jig 700 can be attached to the carriage 11 (as a head holder). However, the maintenance jig 700 may be attached to the heads 20 (including a head array, a head module, a head unit, and the like).

Further, the maintenance jig 700 may be attached not only to a head or a head holder of a serial-type liquid discharge apparatus that employs a carriage. However, the maintenance jig 700 may also be attached to a head or a head holder of a line-type liquid discharge apparatus in which the head does not move.

The maintenance jig 700 according to the embodiments described above may be attached to the heads 20 or the carriage 11 and may be incorporated as a single device. In addition, a liquid discharge apparatus or a liquid discharge system may be constituted that includes the maintenance jig 700 and the heads 20 or the carriage 11 according to any of the above-described embodiments.

Further, in the above-described embodiments, an example in which the heads 20 of the printer 1 that perform printing on the fabric are cleaned using the maintenance jig 700 according to some embodiments of the present disclosure has been described. However, embodiments of the present disclosure are not limited to such a configuration. The maintenance jig 700 can also be used for cleaning a head of a liquid discharge apparatus including a printing device to perform printing on a print target other than fabric.

The term "liquid discharge apparatus" used in the above-described embodiments also represents an apparatus that includes a liquid discharge head or a liquid discharge unit and drives liquid discharge head to discharge liquid. Examples of the liquid discharge apparatus include an apparatus capable of discharging liquid to a material to which liquid can adhere and an apparatus to discharge liquid toward gas or into liquid.

The "liquid discharge apparatus" may include devices to feed, convey, and discharge a material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional object.

The "liquid discharge apparatus" is not limited to an apparatus to discharge liquid to visualize meaningful images, such as letters or figures. For example, an apparatus that forms a meaningless pattern, or an apparatus that fabricates a three-dimensional image are also included.

The above-described term "material on which liquid can adhere" represents a material on which liquid is at least temporarily adhered, a material on which liquid is adhered and fixed, or a material into which liquid is adhered to permeate. Specific examples of the "material on which liquid can adhere" include recording media, such as sheet of paper, recording paper, recording sheet of paper, film, and cloth, electronic component, such as electronic substrate and piezoelectric element, media, such as powder layer, organ model, and testing cell, a car body, and construction materials. The "material on which liquid can adhere" includes any material on which liquid can adhere, unless particularly limited.

Examples of the "material on which liquid can adhere" include any materials on which liquid can adhere even temporarily, such as paper, thread, fiber, fabric, leather, metal, plastic, glass, wood, and ceramic.

Further, the "liquid discharge apparatus" may be a treatment liquid application apparatus that discharges a treatment liquid onto a paper sheet to apply the treatment liquid onto the surface of the paper sheet and modify the surface of the paper sheet, or an injecting granulation apparatus that granulates fine particles of a raw material by spraying a composition liquid containing the raw material dispersed in a solution through a nozzle, or the like.

The terms "image formation," "recording," "printing," "image printing," and "fabricating" used herein can be used synonymously with each other.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

What is claimed is:

1. A maintenance jig comprising:

a protector to be attached to a head that has a nozzle surface including a nozzle row to discharge liquid or a head holder that holds the head to protect the nozzle row; and an opening adjacent to the protector in a lateral direction of the nozzle row intersecting a longitudinal direction of the nozzle row, a distance between an end of the protector in the longitudinal direction of the nozzle row and the nozzle surface being larger than a distance between a portion of the protector other than the end of the protector in the longitudinal direction and the nozzle surface when the maintenance jig is attached to the head or the head holder, wherein a gap is between an opposing surface of the protector and the nozzle surface of the head when the maintenance jig is attached to the head or the head holder, and the opposing surface of the protector is a topmost surface of the protector facing the nozzle surface.

2. The maintenance jig according to claim 1, wherein the opening faces an end of the nozzle surface in a lateral direction of the head intersecting a longitudinal direction of the head.

3. The maintenance jig according to claim 1, wherein the maintenance jig includes a wall on a side of the protector in at least one of a longitudinal direction and a lateral direction intersecting the lateral direction of the head.

4. The maintenance jig according to claim 1, further comprising:

another protector attached to another head or another head holder to protect a nozzle row of said another head; and another opening between the protector and said another protector.

5. The maintenance jig according to claim 1, wherein the end of the protector in the longitudinal direction of the nozzle row faces no nozzle of the nozzle row when the maintenance jig is attached to the head or the head holder.

6. The maintenance jig according to claim 1, wherein the opening faces a space between the nozzle row and another nozzle row of the head.

7. The maintenance jig according to claim 1, wherein the opening faces a space between the nozzle row and another nozzle row of the head that discharge liquids of different colors.

8. A head cleaning method comprising:

attaching the maintenance jig according to claim 1 to a head or a head holder that holds the head; and cleaning a nozzle surface of the head through the opening.

9. The maintenance jig according to claim 1, wherein a width of the nozzle surface in the lateral direction of the nozzle row is larger than a width of the protector in the lateral direction of the nozzle row.

10. A liquid discharge apparatus comprising:

a head that has a nozzle surface including a plurality of nozzle rows to discharge liquids of different colors;

a head holder to hold the head; and a maintenance jig to be attached to the head, the maintenance jig including:

a protector to protect the plurality of nozzle rows of the head; and an opening adjacent to the protector in a lateral direction of the plurality of nozzle rows, the lateral direction intersecting a longitudinal direction of the plurality of nozzle rows, wherein the opening faces a space between the plurality of nozzle rows that discharge liquids of different colors, and a gap is between an opposing surface of the protector and the nozzle surface of the head when the maintenance jig is attached to the head or the head holder, and the opposing surface of the protector is a topmost surface of the protector facing the nozzle surface.

11. The liquid discharge apparatus according to claim 10, wherein a distance between an end portion of the protector in the longitudinal direction of the plurality of nozzle rows and the nozzle surface is larger than a distance between a portion of the protector other than the end of the protector in the longitudinal direction and the nozzle surface when the maintenance jig is attached to the head or the head holder.

* * * * *